United States Patent [19]

Chutter

[11] 3,986,643

[45] Oct. 19, 1976

[54] POWDER DISPENSER

[75] Inventor: Raymond Allen Chutter, Cincinnati, Ohio

[73] Assignee: The Procter & Gamble Company, Cincinnati, Ohio

[22] Filed: Mar. 10, 1975

[21] Appl. No.: 556,603

[52] U.S. Cl. ..... 222/195

[51] Int. Cl.[2] ..... B65G 3/12

[58] Field of Search ..... 222/193, 195, 206, 215, 222/213, 494, 188; 128/266

[56] References Cited

UNITED STATES PATENTS

| | | | |
|---|---|---|---|
| 280,202 | 6/1883 | Mattson | 128/266 |
| 1,507,399 | 9/1924 | McCormick | 222/206 |
| 2,779,126 | 1/1957 | Cook | 222/206 |
| 3,199,923 | 8/1965 | Brooks | 222/195 X |

*Primary Examiner*—Allen N. Knowles
*Assistant Examiner*—Norman L. Stack, Jr.
*Attorney, Agent, or Firm*—Thomas J. Slone; John V. Gorman; Richard C. Witte

[57] ABSTRACT

A powder dispenser for gently issuing puffs of relatively low velocity air-entrained powdered material through a discharge port. The dispenser has means for substantially fluidizing a bed of powdered material contained therein with an upward pulse of relatively low velocity, substantially columnar air flow so that some of the powder in the bed of powdered material becomes entrained in and issued from the dispenser by relatively low velocity air. The dispenser may include a foraminous bulkhead which defines the bottom of a powder accommodating chamber, a plenum chamber subjacent the foraminous bulkhead, and means for pumping a volume of air into the plenum chamber so that a pulse of relatively low velocity air flows upward through the foramina of the bulkhead and the bed of powdered material disposed thereon.

11 Claims, 7 Drawing Figures

POWDER DISPENSER

FIELD OF THE INVENTION

This invention relates generally to dispensers for issuing air-entrained powders such as deodorant powders, talc and other body powders, and insecticide powders.

BACKGROUND OF THE INVENTION

Dispensers for issuing or broadcasting air-entrained powders commonly direct one or more relatively high velocity streams of air or gas through or across a bed of powdered material. The high velocity air causes some of the powdered material to be issued at relatively high velocity from such dispensers.

It will be understood by persons skilled in the art that high velocity discharge of powdered material causes material to be blown all over the general region of use rather than settling on the specific area intended to be powdered. Such general blowing about is highly undesirable with respect to dispensing, for instance, personal or feminine deodorant powders.

The present invention enables dispensing air-entrained powders at relatively low velocity. That is, the present invention enables powders to be dispensed softly and gently in puffs of low velocity air so that the bulk of dispensed powder is applied to the specific area or areas intended to be powdered rather than being blown all over the general region of use.

Some representative prior art powder dispensers are disclosed, for instance, in U.S. Pat. No. 1,400,162 which issued Dec. 13, 1922 to Thomas C. Holmes, U.S. Pat. No. 1,451,138 which issued Apr. 10, 1923 to Samuel Bernstein, and U.S. Pat. No. 2,549,977 which issued Apr. 24, 1951 to Leo R. Kundtz et al. However, none of these has solved all of the problems associated with dispensing air-entrained powders in the manner of the present invention.

SUMMARY OF THE INVENTION

The nature and substance of the present invention will be more readily appreciated after giving consideration to its major aims and purposes. The principal objects of the invention are recited in the ensuing paragraphs in order to provide a better appreciation of its important aspects prior to describing the details of a preferred embodiment in later portions of this description.

A major object of the invention is providing a dispenser for gently issuing air-entrained powdered material.

Another object of the invention is providing a dispenser for gently applying air-entrained powdered material to predetermined areas.

Still another object of the invention is providing a powder puffing dispenser in which a bed of powdered material is substantially fluidized by a column of air forced upward through it, and wherein some of the powdered material is entrained by the air so that air-entrained powder issues from the dispenser.

Yet still another object of the invention is the dispenser described in the preceding paragraph which includes means for puffing air pulses through it so that air-entrained powder is dispensed therefrom at relatively low velocity.

These and other objects of the invention are achieved by providing a dispenser comprising a container adapted to hold a bed of powdered material, a discharge port in an upper wall portion of the container, and means for causing a pulse of air to flow substantially columnarly upwardly through the bed of powdered material so that a puff of air-entrained powdered material issues from the discharge port at relatively low velocity. The means may comprise a foraminous bulkhead which partitions the container into an upper chamber superjacent the foraminous bulkhead for accommodating the bed of powdered material and a plenum chamber subjacent the foraminous bulkhead, and means for pumping a sufficiently large volume of air into the plenum chamber so that a pulse of air flows upward through the foramina of the bulkhead.

BRIEF DESCRIPTION OF THE DRAWINGS

While the specification concludes with claims particularly pointing out and distinctly claiming the subject matter which is regarded as the present invention, it is believed that the invention will be better understood from the following descriptions of a preferred embodiment and three alternate embodiments taken in connection with the accompanying drawings in which:

DESCRIPTION OF THE PREFERRED EMBODIMENT

Figure 1:
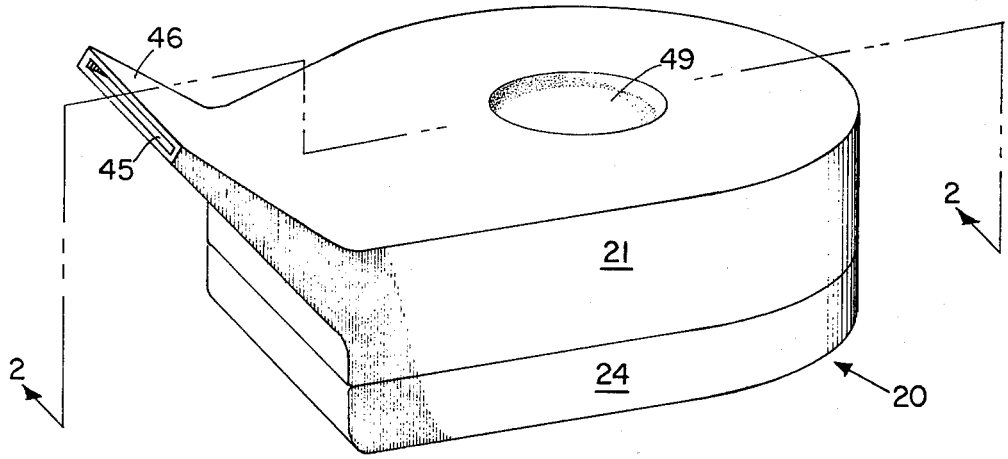
FIG. 1 is a perspective view of a powder dispenser which is a preferred embodiment of the present invention.
Figure 2:
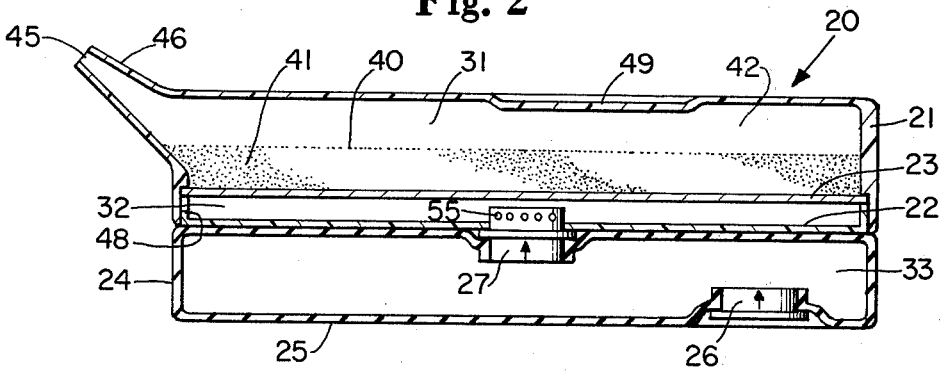
FIG. 2 is a sectional view of the preferred embodiment powder dispenser taken along line 2—2 of FIG. 1.

Referring to FIGS. 1 and 2, a preferred embodiment of the present invention is shown to be a powder dispenser 20 which comprises an upper body 21, a lower body 22, a foraminous bulkhead 23, a squeeze-type pump member 24 having a resilient wall 25, and two one-way check valves 26 and 27.

Briefly, the upper and lower bodies 21, 22 respectively form a container which is partitioned by the foraminous bulkhead 23 into a powder chamber 31 and a plenum chamber 32. The powder chamber 31 is adapted to accommodate a bed 40 of powdered material 41 so that a substantial free space 42 is disposed above the bed of powdered material. The squeeze-type pump member 24 and the valves 26, 27 provide means for pumping a volume or pulse of air into the plenum chamber 32 when the resilient wall 25 is displaced inwardly, and for refilling pump member 24 with ambient air upon releasing the resilient wall 25 so that its resilience returns it to its undisplaced or undeflected position. When a bed 40 of powdered material 41 is disposed on foraminous bulkhead 23 as indicated in FIG. 2, air pumped into the plenum chamber 32 will flow upward through the foramina of the foraminous bulkhead 23, thence columnarly upward through the bed of powdered material 41, and thence out of the dispenser 20 through the discharge port 45 in the distal end of spout 46. This air flow air-entrains some of the powdered material 41 from the bed 40 and causes some air-entrained material to be dispensed in a puff when the pump member 24 of the dispenser 20 is squeezed.

While it might be possible to squeeze the pump member 24 so vigorously that a harsh, high velocity puff would issue from spout 46, the preferred manner of operating or using dispenser 20 is to squeeze the pump member 24 slowly enough to insure gentle, low velocity puffs of air-entrained powdered material. It is believed that the columnar, upward flow or pulse of air through the entire cross section of the bed 40 of powdered material 41 substantially fluidizes the powdered material 41 and thereby enables a relatively low velocity air stream to air-entrain some of the powdered material.

The upper body 21, FIGS. 1 and 2, is preferably molded of substantially rigid thermoplastic material such as polystyrene or polypropylene. The upper body 21 has an integral, upwardly extending spout 46 having a dispensing port 45 disposed in its distal end. The lower portion or skirt of the upper body 21 is provided with a recess 48 for accommodating the foraminous bulkhead 23 and the lower body portion 22 as shown in FIG. 2. The top wall of the upper body of the preferred embodiment powder dispenser 20 also has a depressed area 49 for facilitating holding and squeezing the dispenser 20 in a user's hand as is described hereinafter.

Figure 3:
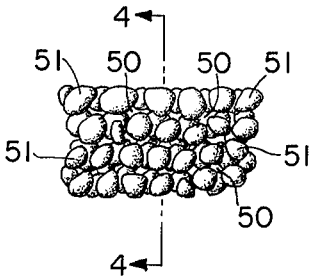
FIG. 3 is a fragmentary plan view of a foraminous bulkhead showing foramina disposed intermediate the particles of material comprising the bulkhead.
Figure 4:
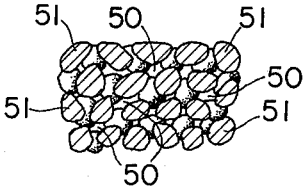
FIG. 4 is a fragmentary sectional view of the foraminous bulkhead shown in FIG. 3 which sectional view was taken along line 4—4 of FIG. 3.

The foraminous bulkhead 23, FIGS. 3 and 4, is preferably of substantially rigid construction inasmuch as the bed of powdered material 41 is disposed thereon. The bulkhead 23 may comprise any foraminous or open pored material such as sintered bronze or open cell polyurethane sheeting so long as the structure provides spaced foramina or through passageways 50 which are sufficiently large to enable upward air flow therethrough yet which are sufficiently small with respect to the sizes of particles of the powdered material 41 to provide means for substantially obviating downward migration of powdered material 41 through the bulkhead 23. Moreover, the pores or passageways through the bulkhead must be sufficiently small to restrict air flow sufficiently to cause air to flow through the whole cross section of the bulkhead despite variations in the depth of the bed of powdered material; even in the event that a portion of the bulkhead has no powdered material disposed on it. As shown somewhat schematically in FIGS. 3 and 4, such foramina 50 may be formed intermediate the structural particles 51 comprising bulkhead 23. In that event, the foramina 50 are simply interconnected interstitial spaces in the bulkhead material.

It will be understood by persons having ordinary skill in the art that if the bulkhead 23 comprises a foraminous material such as open cell polyurethane sheeting, the bulkhead may have to further comprise means not shown for providing sufficient structural rigidity to the sheeting that the bulkhead 23 will support a bed 40 of powdered material 41 disposed on it as shown in FIG. 2. The bulkhead 23 must also be sufficiently rigid to substantially obviate its being deflected upwardly when air is pumped into the plenum chamber 32. Upward deflection would reduce the free space above the bed of powdered material which might impair the efficiency of the dispenser.

The squeeze-type pump member 24 comprises a wall 25 of resilient material such as neoprene or rubber. The chamber within the pump member is designated the pump chamber 33. The wall of the pump member 24 is provided with two apertures which are configured to facilitate installation of the inlet check valve 26 and the outlet check valve 27. The pump member 24 is also configured to facilitate its being secured as by adhesive (not shown) to the underside of the lower body 22 in the position shown in FIG. 2. Alternatively, the pump member 24 may be coupled to the lower body 22 by virtue of each being independently secured to the outlet check valve 27 as by adhesive (not shown) or interference fits (not shown). Thus, the pump member 24 and the valves 26, 27 provide means for displacing a volume or pulse of air through the outlet check valve 27 into the plenum chamber 32 when the resilient wall 25 is deflected inwardly as by squeezing the dispenser. Then, upon releasing the resilient wall 25, it will return to its undeflected position (as shown in FIG. 2) and thereby cause the pump chamber to refill with ambient air through the inlet valve 26. Furthermore, outlet check valve 27 provides means for obviating reverse flow of air from the plenum chamber 32 into the pump chamber 33. Were such reverse flow not obviated, operation of the dispenser would tend to pull powdered material downward into the foramina of the bulkhead when the pump member 24 was released. it is believed this could block some of the foramina from passing air upward therethrough whereby the efficiency of the dispenser would be impaired.

The outlet check valve 27, FIG. 2, is provided with a plurality of radially extending outlet passageways 55 to facilitate air distribution throughout the plenum chamber 32 as air is pumped through the check valve 27 rather than having a stream of air impinging on a relatively small area of bulkhead 23. This air distribution throughout the plenum chamber 32 pressurizes chamber 32 which causes air to move upwardly through the foramina of the foraminous bulkhead 23 so that the air flows columnarly upwardly through the bed 40 of powdered material 41 disposed on the foraminous bulkhead 23.

In operation, the preferred embodiment powder dispenser 20, FIGS. 1 and 2, is preferably held in a user's hand with the thumbprint portion of the user's thumb disposed in the depressed area 49 in the upper body 21, and with the user's fingers wrapped around the bottom of the dispenser. The dispenser 20 is then oriented in the user's hand so that the spout 46 points towards the area intended to be powdered. Upon squeezing the dispenser, the resilient wall 25 is deflected upwardly which causes a puff of air-entrained powdered material 41 from bed 40 to be issued from the spout 46. Upon relaxing the user's hand, the resilient wall 25 will return to its undeflected position (the position as shown in FIG. 2) and cause the pump chamber 33 to refill with ambient air through the inlet check valve 26. The dispenser 20 is then ready to be squeezed again to dispense another puff of air-entrained powdered material 41.

ALTERNATE EMBODIMENTS

Figure 5:
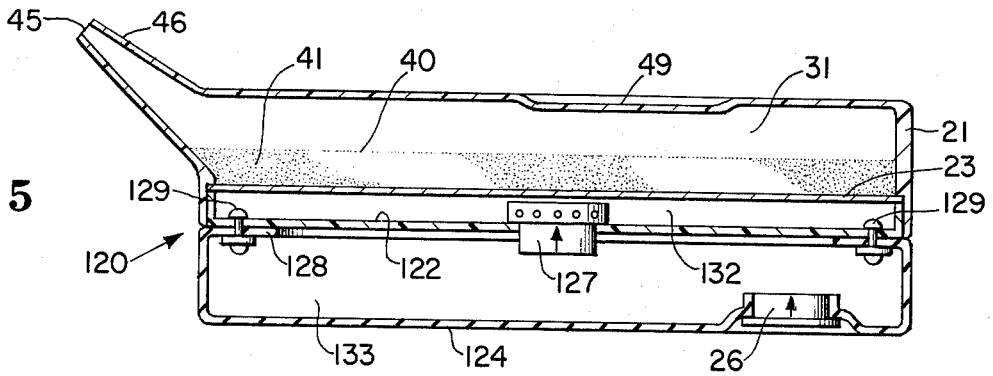
FIG. 5 is a sectional view similar to FIG. 2 of a first alternate embodiment powder dispenser.
Figure 6:
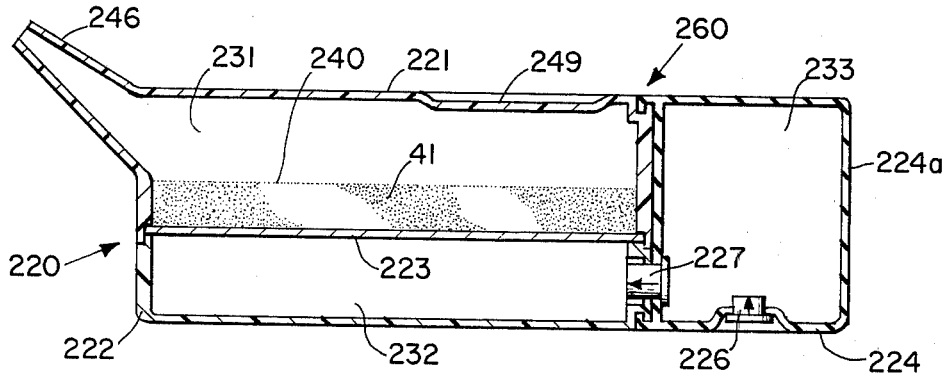
FIG. 6 is a sectional view similar to FIG. 2 of a second alternate embodiment powder dispenser.
Figure 7:
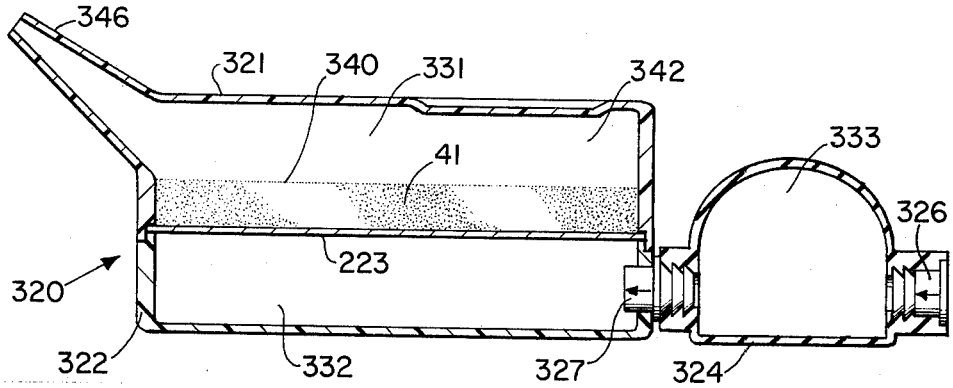
FIG. 7 is a sectional view similar to FIG. 2 of a third alternate embodiment powder dispenser.

Three alternate embodiment powder dispensers 120, 220, and 320 are shown in FIGS. 5, 6, and 7 respectively. All of the alternate dispensers function substantially the same as the preferred embodiment dispenser 20. Therefor, in order to avoid undue repetition, alternate dispensers 120, 220, and 320 are described in terms of structural and methods-of-use differences with respect to the preferred embodiment powder dispenser 20, FIGS. 1 and 2, and with respect to such differences among the alternate embodiments. Unless otherwise designated, corresponding members and features of all of the alternate dispensers shown in FIGS. 5, 6, and 7 will be understood to be substantially identical to those of the preferred embodiment dispenser 20, FIGS. 1 and 2.

The first alternate embodiment powder dispenser 120, FIG. 5, is substantially like the preferred embodiment dispenser 20, FIGS. 1 and 2, except the pump chamber 133 of alternate dispenser 120 is defined by the underside of the lower body 122 and a cup-shape resilient pump member 124 having an inturned rim 128. The rim 128 of the resilient pump member 124 is secured as by a plurality of circumferentially spaced rivits 129 or the like to the underside of the lower body 122 as shown in FIG. 5. As a result of not having a top wall in the cup-shape resilient pump member 124, the outlet check valve 127 is adapted to be secured in an aperture through the lower body 122 to interconnect the pump chamber 133 with the plenum chamber 132.

The first alternate dispenser 120, FIG. 5, is used and functions in the same manner as the preferred embodiment dispenser 20, FIGS. 1 and 2.

The second alternate powder dispenser 220, FIG. 6, comprises an upper body 221, a lower body 222, a foraminous bulkhead 223, a squeeze-type air pump 224 which forms the end of the dispenser 220 disposed oppositely from the spout 246, and inlet and outlet check valves 226 and 227 respectively. When assembled as shown in FIG. 6, the dispenser is divided into a powder chamber 231, a plenum chamber 232, and a pump chamber 233 which chambers serve the same functions as their counterparts in dispensers 20 and 120 described hereinbefore.

Structurally, the upper body 221 of alternate dispenser 220 is configured to accommodate a deeper bed 240 of powdered material 41 of smaller horizontal cross sectional area than the preferred embodiment dispenser 20, FIG. 2, and the first alternate dispenser 120, FIG. 5. Furthermore, the upper body 221, the lower body 222, and the pump 224 are provided with flanges 260 to mechanically interlock the pump 224 with the body members 221, 222 after the upper and lower bodies 221 and 222 have been secured together with the foraminous bulkhead 223 disposed therebetween.

The second alternate dispenser 220 functions like the dispensers 20 and 120 described hereinbefore. However, to use the second alternate dispenser 220, it is preferably grasped in the hand of a user by placing the thumbprint portion of the user's thumb in the depression 249, wrapping the user's index finger and second finger around the back wall of the pump 224 and wrapping the user's third finger and little finger and the bottom of the dispenser. When held in this manner, powder puffing is achieved by alternately curling and straightening the user's index and second fingers.

The third alternate powder dispenser 320, FIG. 7, comprises an upper body 321, a lower body 322, a foraminous bulkhead 223, and a squeeze-type air pump 324 having inlet and outlet check valves 326 and 327 respectively. The outlet check valve 327 is adapted to couple the pump 324 to the lower body 322 as shown in FIG. 7. When thus assembled, the dispenser comprises a powder chamber 331, a plenum chamber 332, and a pump chamber 333. As in the other embodiments, the powder chamber 331 is adapted to accommodate a bed 340 of powdered material 41 on bulkhead 223, and to provide a substantial free space 342 superjacent the powdered material.

Of all the dispenser embodiments 20, 120, 220 and 320, the third alternate dispenser 320, FIG. 7, is most like the second alternate dispenser 220, FIG. 6, inasmuch as dispenser 320 will accommodate a deeper bed 340 of powdered material 41 having a smaller horizontal cross sectional area than dispensers 20 and 120. However, to use the third alternate dispenser 320, its body is preferably grasped by one hand of the user while the squeeze-type pump 324 is operated by the other hand of the user.

While particular embodiments of the present invention have been illustrated and described, it will be obvious to those skilled in the art that various changes and modifications can be made without departing from the spirit and scope of the invention. Therefore, it is intended to cover the appended claims, all such changes and modifications that are within the scope of this invention.

What is claimed is:

1. A powder dispenser comprising a container adapted to hold a bed of powdered material, a discharge port in an upper wall portion of said container, and means for causing a relatively low velocity pulse of air to flow substantially columnarly upwardly through the entire cross section of said bed so that a puff of air-entrained powdered material issues from said discharge port at relatively low velocity, said means comprising a foraminous bulkhead so disposed within said container that said bed of powdered material will be disposed on the upwardly facing surface of said foraminous bulkhead.

2. A powder dispenser comprising a container adapted to hold a bed of powdered material, a discharge port in an upper wall portion of said container, and means for causing a relatively low velocity pulse of air to flow substantially columnarly upwardly through the entire cross section of said bed so that a puff of air-entrained powder material issues from said discharge port at relatively low velocity, said means comprising a foraminous bulkhead, a squeeze-type air pump having a resilient wall, and one-way flow control means, said foraminous bulkhead being disposed to partition said container into an upper chamber superjacent said foraminous bulkhead for accommodating said bed of powdered material on the upwardly facing surface of said foraminous bulkhead, and a plenum chamber subjacent said foraminous bulkhead, said pump being connected to said plenum chamber through said flow control means to enable displacing air from said pump into said plenum chamber so that said air is diffused in said plenum chamber, said pump having a sufficiently large displacement capacity that said bed can be substantially fluidized by a pulse of air generated by displacing said resilient wall inwardly, said pulse of air passing into and diffusing in said plenum chamber and thence upwardly through the foramina of said bulkhead and said bed of powdered material disposed on said foraminous bulkhead.

3. A powder dispenser comprising a container adapted to hold a bed of powdered material, a foraminous bulkhead, and squeeze-type air pumping means, said foraminous bulkhead being configured and disposed to partition said container into a powder chamber superjacent said foraminous bulkhead for accommodating said bed of powdered material on the upwardly facing surface of said foraminous bulkhead, and a plenum chamber subjacent said foraminous bulkhead, said powder chamber being further defined in part by an upper wall portion of said container having a discharge port through it, said pumping means comprising means for pumping puffs of air into and diffusing within said plenum chamber so that the gas will pass through virtually the entire cross section of said foraminous bulkhead, thence columnarly through any powder disposed on said foraminous bulkhead, and thence outward through said discharge port whereby some of said powder will be air entrained and dispensed.

4. The powder dispenser of claim 3 wherein said pumping means comprises a resilient bulb and valve means which are so configured and disposed that, when said bulb is squeezed, air will be forced from said bulb into said plenum chamber and, when said bulb is released, said bulb will refill with ambient air.

5. The powder dispenser of claim 3 wherein said means for pumping comprises a plenum bulkhead, two check valves, and a resilient wall portion of said container, said plenum bulkhead being so configured and disposed that a pump chamber is defined at least in part by said plenum bulkhead and said resilient wall portion of said container, said check valves being so configured and disposed that when said resilient wall portion is deflected inwardly, air disposed in said pump chamber will be forced through one of said check valves into said plenum chamber and, when said resilient wall portion returns to its undeflected position, said pump chamber will refill with ambient air through the other of said check valves.

6. The powder dispenser of claim 3 wherein said upper wall portion of said container defines an outwardly extending spout and said discharge port is disposed in the distal end of said spout.

7. A powder dispenser comprising a container adapted to hold a bed of powdered material, a foraminous bulkhead, a plenum bulkhead, and valve means, said container having a resilient wall portion, and a discharge spout extending outwardly from an upper wall portion, said bulkheads being configured and disposed to divide the interior of said container into three chambers, said chambers being a powder chamber superjacent said foraminous bulkhead for accommodating said bed of powdered material on said foraminous bulkhead, a plenum chamber subjacent said foraminous bulkhead, and a pump chamber in fluid communication with said plenum chamber, said pump chamber being defined at least in part by said plenum bulkhead and said resilient wall portion, said valve means being so configured and disposed that when said resilient wall portion is deflected inwardly, air displaced thereby is forced from said pump chamber into and diffuses within said plenum chamber, and thence serially through said foraminous bulkhead, said powder chamber, and said spout whereby said air will entrain some powder disposed in said bed of powdered material disposed on said foraminous bulkhead and dispense air entrained powder through said spout and, when said resilient wall portion is released, said pump chamber will refill with ambient air.

8. The powder dispenser of claim 1 wherein said foraminous bulkhead comprises material having spaced foramina which foramina are sufficiently large to enable upward air flow therethrough yet which foramina are sufficiently small with respect to the sizes of particles constituting said bed of powdered material that the foramina are means for substantially obviating downward migration of said particles through said foraminous bulkhead, and said foramina are sufficiently small that they are means for sufficiently restricting air flow therethrough to cause air to flow through the whole cross section of said foraminous bulkhead despite variations in the depth of said bed of powdered material disposed thereon.

9. The powder dispenser of claim 2 wherein said foraminous bulkhead comprises material having spaced foramina which foramina are sufficiently large to enable upward air flow therethrough yet which foramina are sufficiently small with respect to the sizes of particles constituting said bed of powdered material that the foramina are means for substantially obviating downward migration of said particles through said foraminous bulkhead, and said foramina are sufficiently small that they are means for sufficiently restricting air flow therethrough to cause air to flow through the whole cross section of said foraminous bulkhead despite variations in the depth of said bed of powdered material disposed thereon.

10. The powder dispenser of claim 3 wherein said foraminous bulkhead comprises material having spaced foramina which foramina are sufficiently large to enable upward air flow therethrough yet which foramina are sufficiently small with respect to the sizes of particles constituting said bed of powdered material that the foramina are means for substantially obviating downward migration of said particles through said foraminous bulkhead, and said foramina are sufficiently small that they are means for sufficiently restricting air flow therethrough to cause air to flow through the whole cross section of said foraminous bulkhead despite variations in the depth of said bed of powdered material disposed thereon.

11. The powder dispenser of claim 7 wherein said foraminous bulkhead comprises material having spaced foramina which foramina are sufficiently large to enable upward air flow therethrough yet which foramina are sufficiently small with respect to the sizes of particles constituting said bed of powdered material that the foramina are means for substantially obviating downward migration of said particles through said foraminous bulkhead, and said foramina are sufficiently small that they are means for sufficiently restricting air flow therethrough to cause air to flow through the whole cross section of said foraminous bulkhead despite variations in the depth of said bed of powdered material disposed thereon.

* * * * *